US008443870B2

(12) United States Patent
Hanamura

(10) Patent No.: US 8,443,870 B2
(45) Date of Patent: May 21, 2013

(54) STEAM HEAT EXCHANGER

(76) Inventor: Masaaki Hanamura, Nagano (JP)

( * ) Notice: Subject to any disclaimer, the term of this patent is extended or adjusted under 35 U.S.C. 154(b) by 1395 days.

(21) Appl. No.: 12/084,613

(22) PCT Filed: Nov. 16, 2006

(86) PCT No.: PCT/JP2006/322853
§ 371 (c)(1),
(2), (4) Date: May 5, 2008

(87) PCT Pub. No.: WO2007/058256
PCT Pub. Date: May 24, 2007

(65) Prior Publication Data

US 2009/0107659 A1 Apr. 30, 2009

(30) Foreign Application Priority Data

Nov. 17, 2005 (JP) ..... 2005-332470
Oct. 25, 2006 (JP) ..... 2006-289585

(51) Int. Cl.
*F25B 1/02* (2006.01)

(52) U.S. Cl.
USPC ..... 165/110; 165/157

(58) Field of Classification Search
USPC ..... 165/110, 157
See application file for complete search history.

(56) References Cited

U.S. PATENT DOCUMENTS 2,661,190 A * 12/1953 Alton ..... 165/11.1
3,289,745 A * 12/1966 Leonard, Jr. ..... 165/218
3,715,870 A * 2/1973 Guzick ..... 55/466
4,903,491 A * 2/1990 Larinoff ..... 60/692
5,320,163 A 6/1994 Stoodley
2010/0263845 A1* 10/2010 Fujiwara ..... 165/157

FOREIGN PATENT DOCUMENTS

| | | |
|---|---|---|
| GB | 26 788 | 0/1910 |
| GB | 143 822 | 5/1920 |
| GB | 160 716 | 3/1921 |
| JP | 63-113296 | 5/1988 |
| JP | 07-41256 | 7/1995 |
| JP | 2004-008417 | 1/2004 |

OTHER PUBLICATIONS

European Patent Office Search Report dated Jun. 12, 2009 (2 pages).

* cited by examiner

*Primary Examiner* — Allen Flanigan
(74) *Attorney, Agent, or Firm* — Flynn, Thiel, Boutell & Tanis, P.C.

(57) ABSTRACT

A steam heat exchanger includes a steam heating pipe with a condensation pipe part and a sensible heat pipe part provided on the lower side of the condensation pipe part. In the condensation pipe part, a liquid is heated by latent heat. The drain discharge capacity in a steam trap or an orifice disposed on the drain discharge side equals the amount of condensation at the service temperature of the steam heat exchanger. Condensed water produced after the heat exchange in the condensation pipe part enters the sensible heat pipe part on the downstream side to hold the sensible heat pipe part in a water sealed state. In this sensible heat pipe part, the liquid is heated by sensible heat. Heat exchange efficiency is improved by using latent and sensible heat, the amount of steam used can be reduced, and the load of a steam generation source can be reduced.

1 Claim, 7 Drawing Sheets

STEAM HEAT EXCHANGER

TECHNICAL FIELD

The present invention relates to a steam heat exchanger suitable for use in heating a heat treatment tank used in metal plating treatment and the like, and more specifically relates to a steam heat exchanger that can heat a heating object with good efficiency using a low amount of steam by making use of sensible heat.

BACKGROUND ART

The heat treatment tank of a workpiece used in metal plating treatment and the like uses a steam heat exchanger having a configuration in which a steam heating pipe is disposed on the bottom side of the tank interior, and the workpiece inside the heat treatment tank filled with a treatment liquid is heated. An example of a conventional steam heat exchanger disposed in an open treatment tank is shown in FIGS. 3 and 4.

The steam heat exchanger 100 shown in FIG. 3 is a lift-fitting steam heat exchanger and has a steam heating pipe 103 drawn about in the form of an accordion so as to be two-tiered in the vertical direction in a position near the bottom surface of an open heat treatment tank 102 in which the treatment liquid 101 is held. Steam at a prescribed pressure is supplied from a boiler or another steam supply source 105 to a steam heating pipe 103 by way of a steam supply pipe 104. Heat is exchanged with the treatment fluid 101 by using the latent heat of steam provided through the steam heating pipe 103. Heat-exchanged steam becomes condensed water (saturated water), enters a steam heating pipe 103*a* on the lower side, and is recovered via this route from the drain conduit 106 by way of a steam trap 107 or another drain discharge device.

Also, the steam heat exchanger 200 shown in FIG. 4 is an example of a steam heat exchanger in which the drain is evacuated from the bottom of an open tank 201 and which does not require lift fittings. This steam heat exchanger 200 is provided with a steam supply port 202 and a steam discharge port 203 on the side of the open tank 201, and the steam heating pipe 204 extends into the tank interior from this location in a horizontal 'U' shape. In this case as well, the latent heat of steam that passes through the steam heating pipe 204 is used for exchanging heat with the treatment fluid 205 in the tank.

In this case, the following structures and methods of use are commonly adopted in conventional steam heat exchangers that use the latent heat of steam to perform heat exchange.

(1) Since the large condensation heat transfer rate of steam is utilized, a structure is adopted in which condensation water is smoothly separated from the heat transfer surface, and the heat exchange surface is constantly covered by steam without being submerged.

(2) The discharge capacity is greater than the required condensation rate at the service temperature of the steam heat exchanger with consideration given to the start load of the steam trap, and the discharge capacity is ordinarily double or more than required so that condensation water can be smoothly evacuated from the steam heat exchanger.

(3) The evaporation heat of steam used in heat exchange decreases as pressure increases. For this reason, steam heat exchangers are operated at the lowest possible pressure. As a result, there are cases in which a drain lifter, a vacuum pump, or another drain recovery apparatus is required in condensate recovery.

(4) A preheater that uses drainage evacuated from the steam trap is sometimes provided to increase the heat efficiency of steam heat exchangers. In these cases, only flash steam can be used to prevent water hammering, and it is often the case that the cost-reducing effect is poor because there are limitations to the pressure of a drain recovery pipe.

(5) Since the heat capacity of steam per unit volume is low, two-position control for controlling steam is sufficient in steam heat exchangers in which the start up time is considerable. In positional proportional control, the steam part readily reaches a pressure below the back pressure of the steam trap in addition to undergoing a vacuum phenomenon of the heat exchanger steam part. As a result, smooth drain discharge becomes difficult and there are many cases in which positional proportional control has no significance.

DISCLOSURE OF THE INVENTION

An object of the present invention is to provide a steam heat exchanger that can perform heat exchange with good efficiency by additionally using sensible heat that is conventionally unused.

According to the present invention, there is provided a steam heat exchanger for converting a fluid inside a pipe into steam, characterized in comprising:

a condensation heat transfer part; and a sensible heat transfer part that is formed on the downstream side of the condensation heat transfer part, water sealed, and provided with a fixed direction of flow.

In this case, it is preferred that an orifice of a prescribed bore diameter be formed in a downstream end of the sensible heat transfer part. An orifice may also be formed in an intermediate location of the sensible heat transfer part.

In this case, it is preferred that the drain discharge amount regulated by the orifice be set so as to be the same as the amount of steam condensation at the service temperature of the steam heat exchanger.

Next, instead of the orifice, a steam trap or another drain discharge device may be connected to a downstream end of the sensible heat transfer part. In this case as well, it is preferred that the drain discharge amount of the drain discharge device be set so as to be the same as the amount of steam condensation at the service temperature of the steam heat exchanger.

The steam heat exchanging system of the present invention is characterized in comprising an open treatment tank or a pressure tank; and a steam heat exchanger for heating the treatment fluid held in the open treatment tank or the pressurized tank, wherein a steam heat exchanger according to any of the configurations described above is used as the steam heat exchanger.

Since a sensible heat transfer part is provided in addition to the condensation heat transfer part in the steam heat exchanger of the present invention, sensible heat can be used, the amount of heat transferred by the heat exchanger can be increased by a commensurate amount, and the amount of steam that is used can be reduced. In this case, the amount of heat that is exchanged is normally significantly reduced because the drain in the condensation heat transfer part may back up and the heat transfer surface may become submerged when the drain discharge amount is merely adjusted, but such an adverse effect does not occur in the present invention.

Also, condensation water that enters the sensible heat transfer part when air is supplied becomes compressed water and there is no air in the sensible heat transfer part when air is supplied. When air supply is suspended, the compressed water in the sensible heat transfer part becomes saturated water and, though there are some cases of re-evaporation, condensation occurs again simultaneous to the supply of air and increased pressure. Consequently, even if an electromagnetic valve or another primary-side steam valve is rapidly opened and closed, water hammering work is not generated.

Therefore, in accordance with the steam heat exchanger of the present invention, the following effects are obtained.

(a) Heat can be effectively utilized because even the sensible heat of steam can be used without the accompanying danger of water hammering. As a result, an effect can be obtained in which the amount of primary-side steam flow is reduced and the load on a steam generation source such as a boiler can be alleviated.

(b) By taking into account the surface area of the sensible heat transfer part, steam can be used at a high pressure without diminishing thermal efficiency. The resulting effect is that a drain recovery apparatus such as a vacuum pump is unnecessary on the drain recovery side and that the diameter of a steam control valve or steam pipe can be made smaller.

(c) By taking into account the surface of the sensible heat transfer part, re-evaporation inside a drain conduit can be prevented. For this reason, an effect can be obtained in which the diameter of a condensate pipeline can be made smaller and the radiation loss from the condensate pipeline can be greatly decreased because the drain temperature is also low.

(d) By taking into account the surface area and the mounting position of the sensible heat transfer part, the temperature of the condensed water can be reduced to the service temperature of the heat exchanger or below.

(e) Since only compressed water is present in the sensible heat transfer part and further downstream therefrom, it is sufficient to provide an orifice having a prescribed bore diameter on the secondary side of the sensible heat transfer part in place of a drain discharge device such as a steam trap. Also, if this servicing is not desirable, the mounting position for the orifice may be inside the sensible heat transfer part.

BEST MODE FOR CARRYING OUT THE INVENTION

Described below with reference to drawings are embodiments of the steam heat exchange system provided with a steam heat exchanger in which the present invention has been applied.

Embodiment 1

Figure 1:
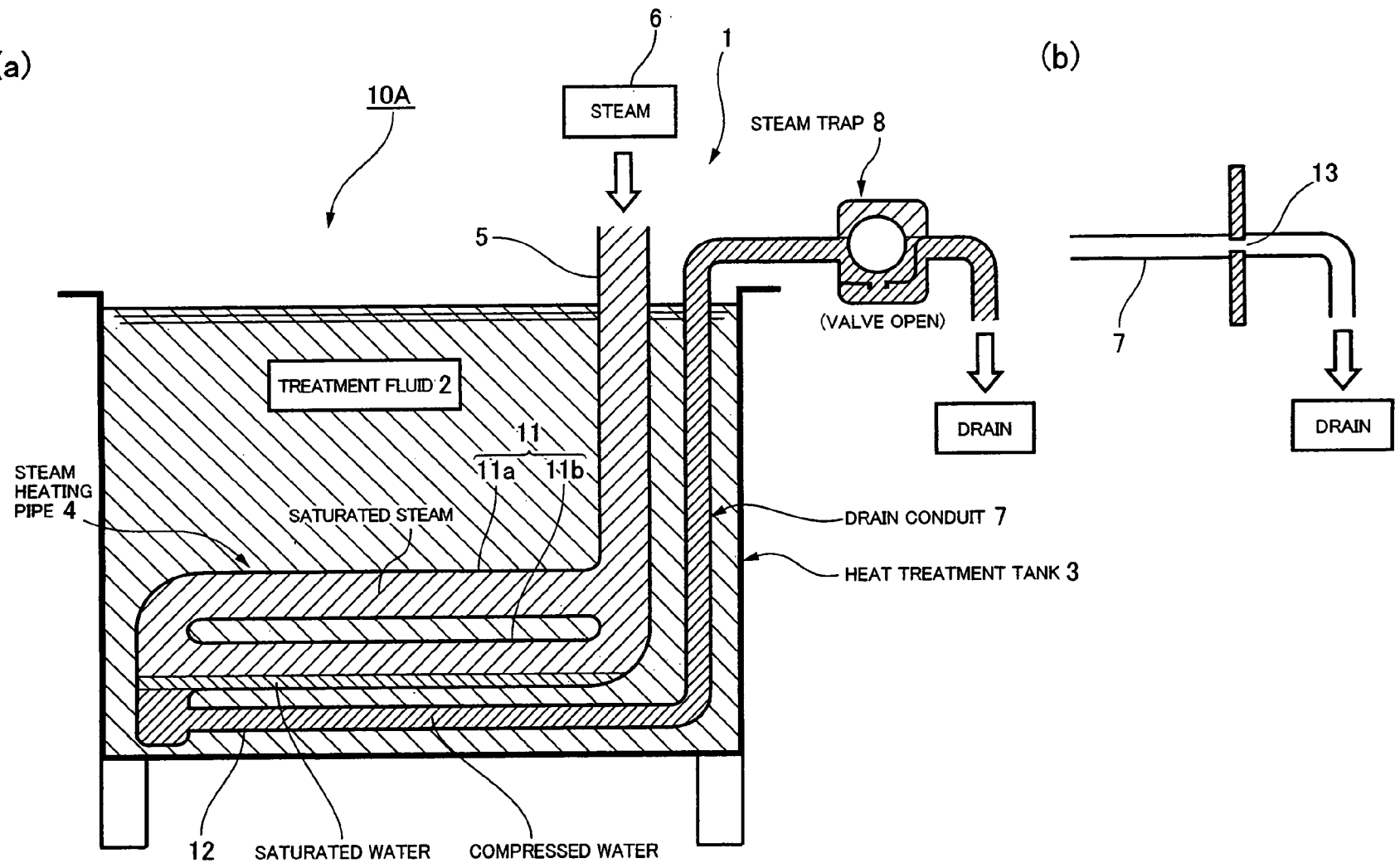
FIG. 1(*a*) is a schematic structural diagram showing a heating system provided with the steam heat exchanger of the present invention, and (b) is an illustrative diagram of a case in which an orifice is used in place of a steam trap.

FIG. 1(*a*) is a schematic structural diagram showing a heating system provided with the steam heat exchanger to which the present invention has been applied. A steam heat exchange system 10A has a steam heat exchanger 1 and an open heat treatment tank 3 which holds the treatment fluid 2 of the heating object. The steam heat exchanger 1 has a steam heating pipe 4 in the form of an accordion which is horizontally disposed in the vicinity of the bottom surface of the heat treatment tank 3. A steam supply pipe 5 stands vertically erect from the end part of the upstream side of the steam heating pipe 4, and steam having a prescribed temperature is supplied through this steam supply pipe 5 from a boiler or another steam generation source 6. A drain conduit 7 stands vertically erect from the end part of the downstream side of the steam heating pipe 4, and the drain is evacuated through the drain conduit 7 and a steam trap 8.

The steam heating pipe 4 is provided with a plurality of horizontally disposed condensation heat transfer pipe parts 11 on the upper side, and a plurality of horizontally disposed sensible heat transfer pipe parts 12 on the lower side. Each of the heat transfer pipe parts 11 has a configuration in which the two ends of the parallelly extending and vertically disposed plurality of pipe parts 11*a* and 11*b* are connected to each other, and the lower end of the steam supply pipe 5 is connected to the end part of one side. The end part of the other side of the condensation heat transfer pipe part 11 is linked to one end side portion of the corresponding] sensible heat transfer part 12 which is positioned on the lower side, and the portion of the other end side of the sensible heat transfer pipe part 11 is linked to the lower end of the drain conduit 7 which stands vertically erect.

In the steam heat exchanger 1 having this configuration, the liquid as the heating object is heated by the latent heat in the condensation heat transfer pipe parts 11. The drain discharge capacity of the steam trap 8 is set so as to be the same as the amount of condensation at the service temperature of the steam heat exchanger 1. Consequently, condensation water generated after heat transfer in the condensation heat transfer pipe parts 11 enters the sensible heat transfer pipe parts 12 on the downstream side substantially without remaining in the condensation heat transfer pipe parts 11, and the water sealed state of the sensible heat transfer pipe parts 12 is maintained. The liquid as the heating object is heated by sensible heat in the sensible heat transfer pipe parts 12. Additionally, the sensible heat transfer pipe parts 12 can be economically manufactured with a small heat transfer surface area as long as the heat transfer pipe parts are designed so as to be composed of the fewest possible rows and have the smallest possible pipe diameter within pressure loss tolerance levels.

Figure 3:
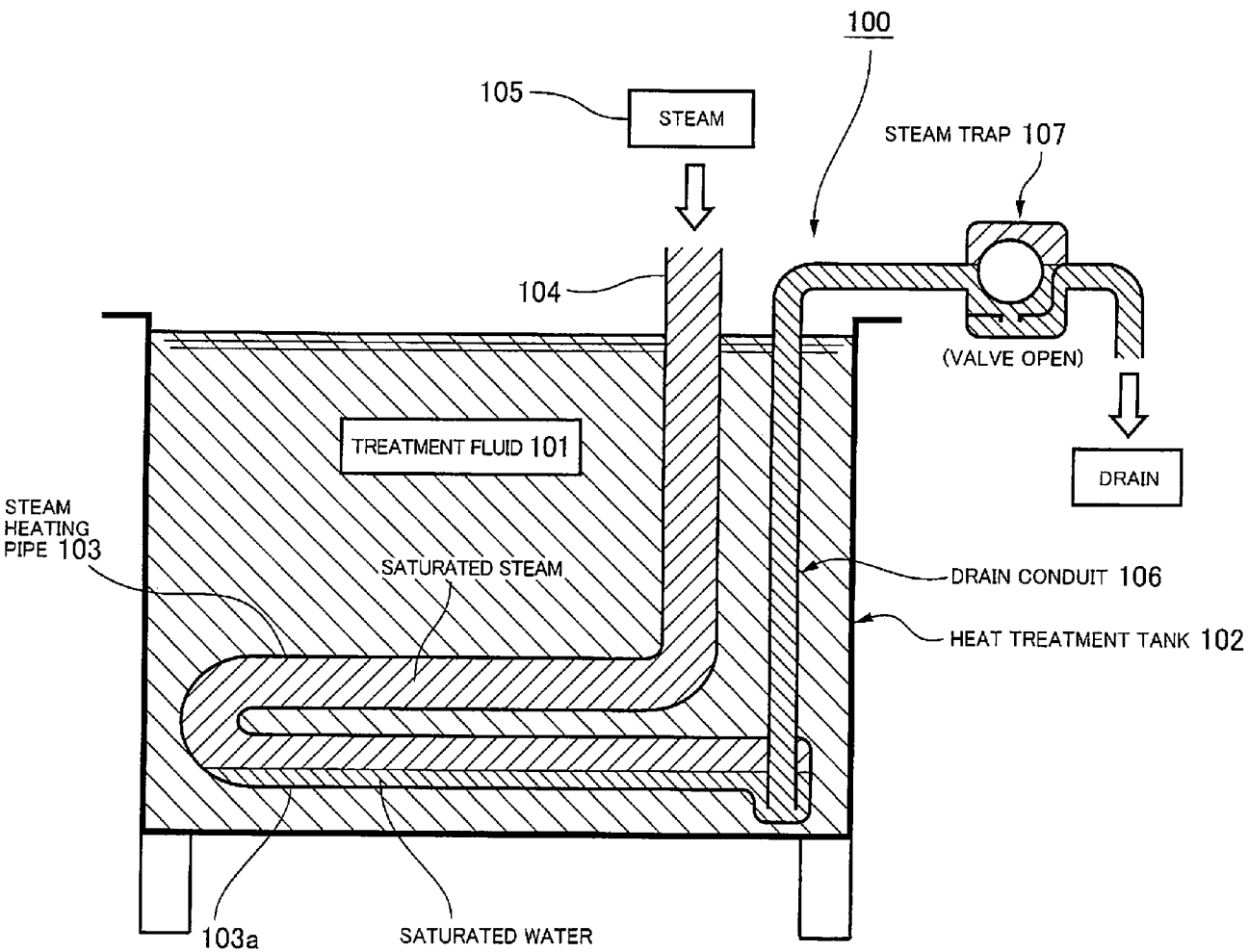
FIG. 3 PRIOR ART
FIG. 3 is a schematic structural diagram showing a conventional steam heat exchanger.
Figure 4:
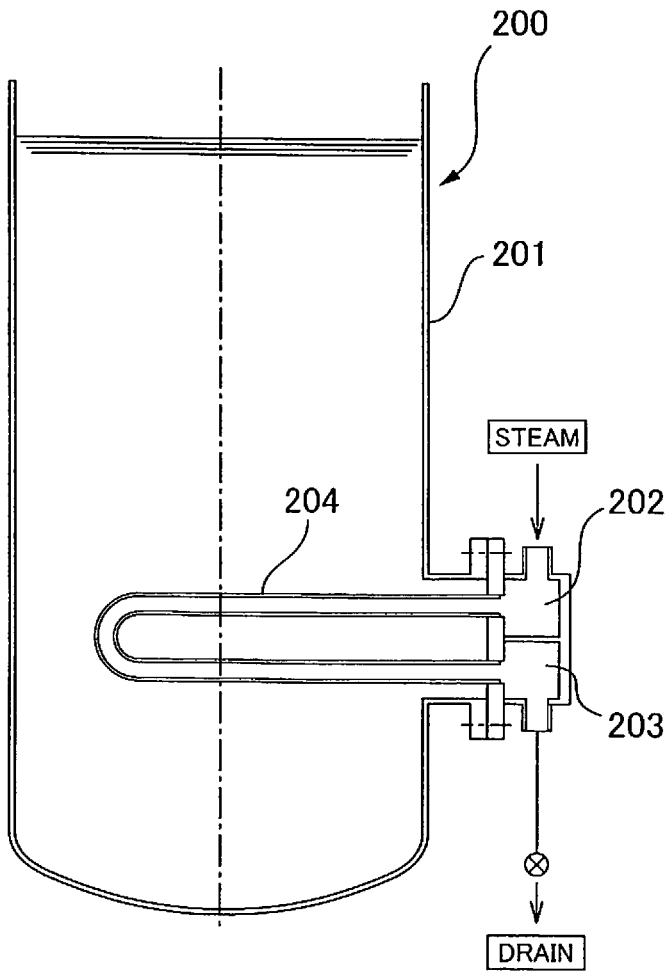
FIG. 4 PRIOR ART
FIG. 4 is a schematic structural diagram showing a separate example of a conventional steam heat exchanger.
Figure 5:
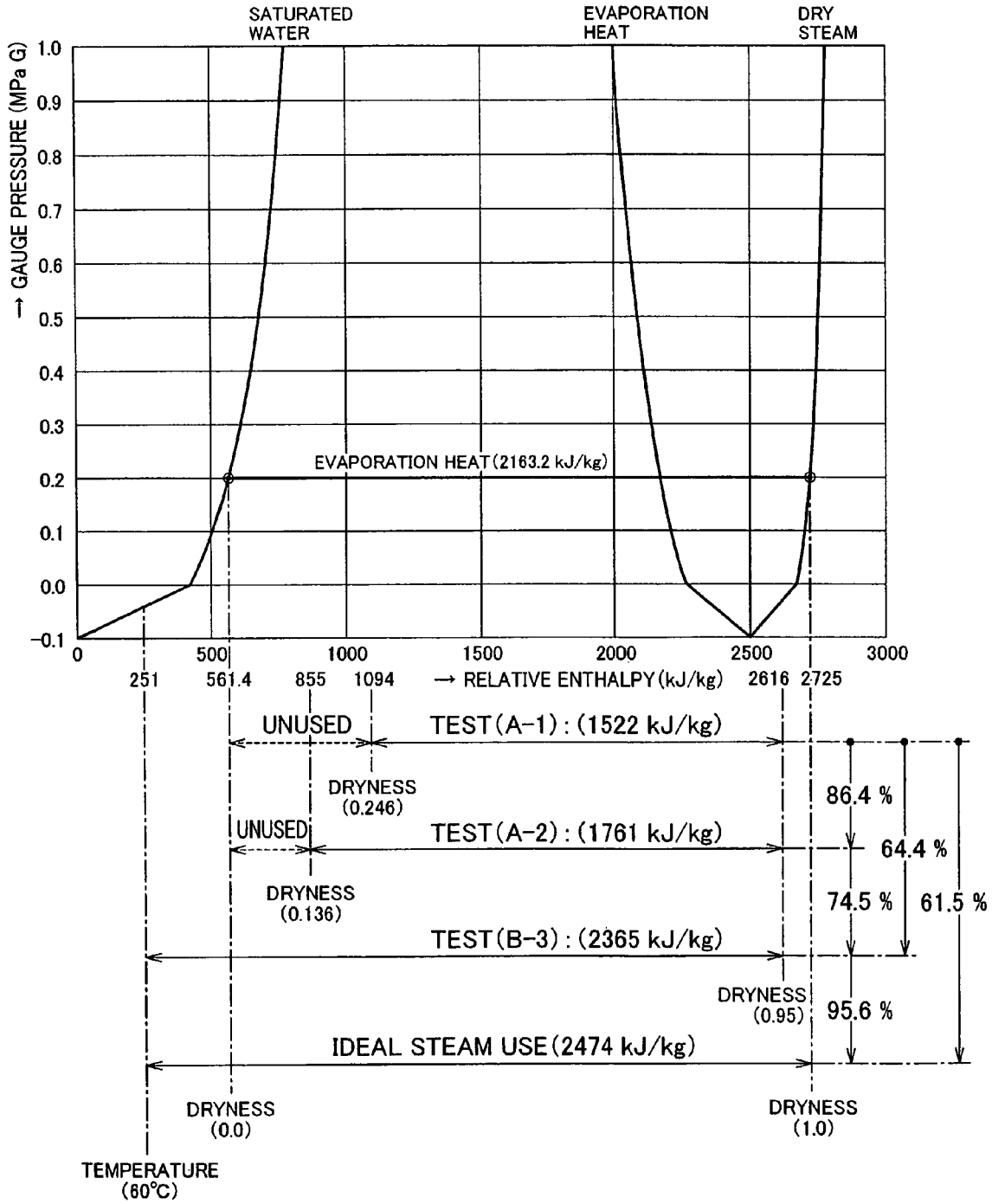
FIG. 5 is an illustrative diagram showing the steam utilization ratio of the results of a temperature elevation test together with a steam chart.
Figure 6:
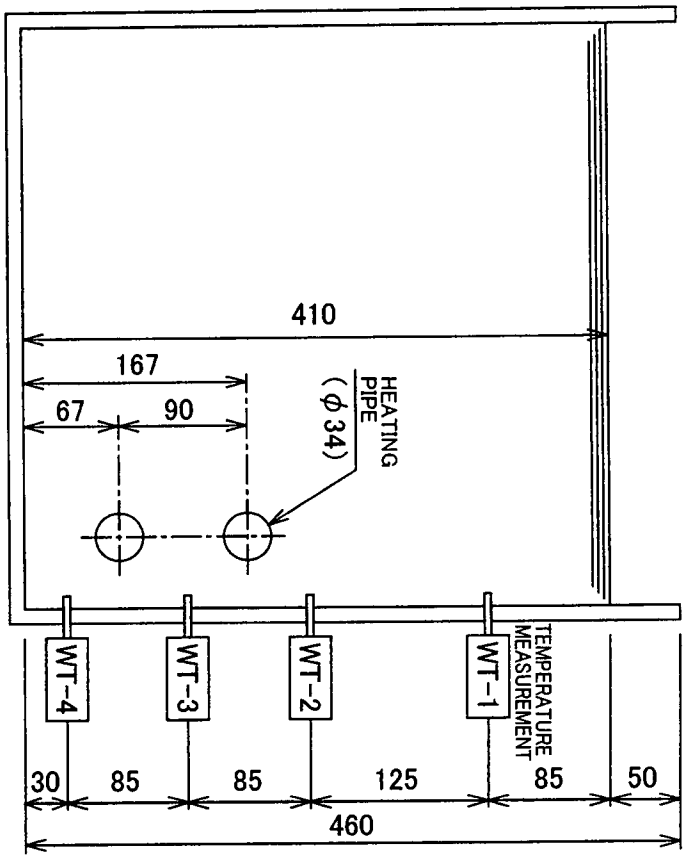
FIG. 6 is an illustrative diagram showing the temperature measurement positions in the temperature elevation test.
Figure 7:
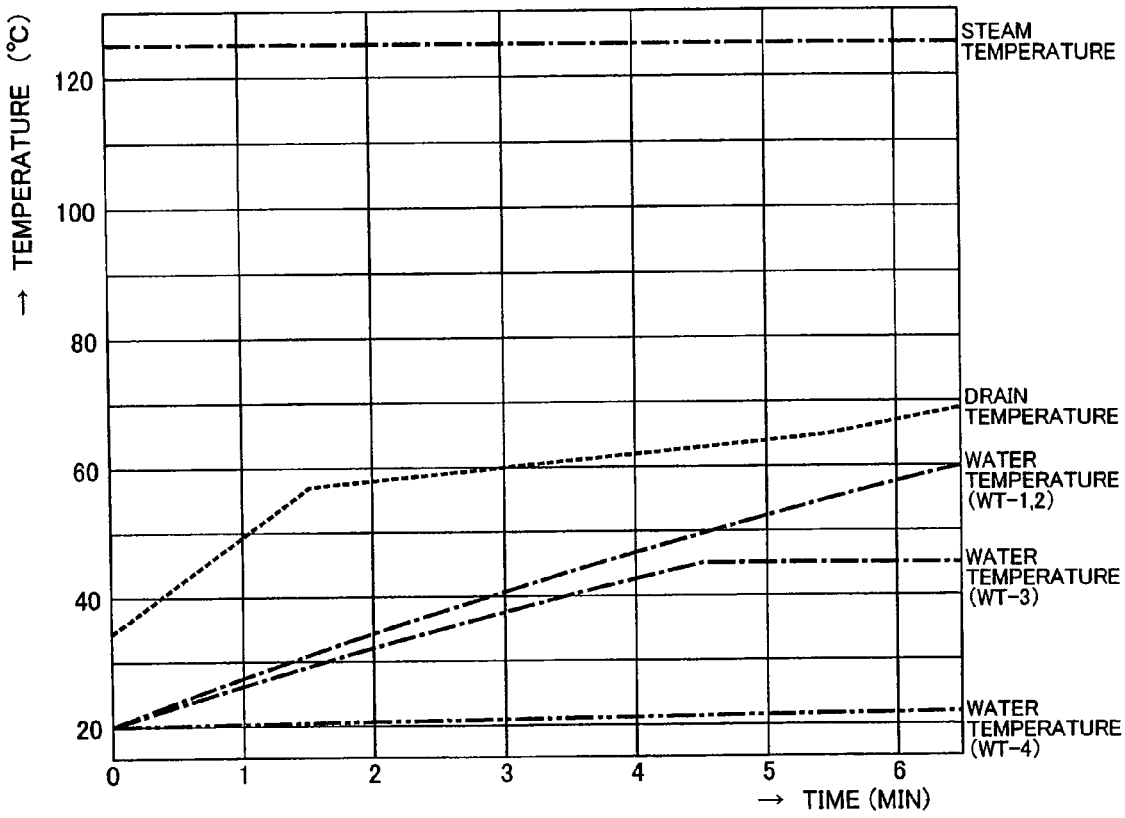
FIG. 7 is a graph showing the state of temperature changes in each measurement position for the case of sample B-3 in the temperature elevation test.

The present inventors carried out a temperature elevation test under various types of conditions using the steam heat exchanger 1 and the conventional steam heat exchanger 100 shown in FIG. 3 in order to confirm the effect of the steam heat exchanger 1. The test conditions and test results of each sample A-1 through A-3 and B-1 through B-3 of the temperature elevation tests are shown in Table 1. Samples A-1 through A-3 used the conventional steam heat exchanger 100 shown in FIG. 3, and samples B-1 through B-3 used the steam heat exchanger 1 of the present example shown in FIG. 1. Also, FIG. 5 is an illustrative diagram showing the steam utilization ratio of a portion of the results of the temperature elevation test together with a steam chart, FIG. 6 is an illustrative diagram showing the temperature measurement positions during the test, and FIG. 7 is a graph showing the state of temperature changes in each measurement position in the temperature elevation test in the case of sample B-3.

TABLE 1

| Sample | Heat transfer method | Steam pressure (MPa) | Rising temperature time (min) | Amount of steam used (kg) | Steam utilization ratio (%) | Drain discharge side |
|---|---|---|---|---|---|---|
| A-1 | Existing Method | 0.18 | 6'50" | 13.64 | 100.0 | Disk trap bypass valve open |
| A-2 | Existing Method | 0.18 | 7'55" | 11.79 | 86.4 | Disk trap bypass valve closed |
| A-3 | Existing Method | 0.18 | 10'30" | 9.48 | 69.5 | Float trap optimal orifice |
| B-1 | New Method | 0.18 | 5'40" | 12.05 | 88.3 | Disk trap bypass valve open |
| B-2 | New Method | 0.18 | 6'10" | 11.40 | 83.6 | Disk trap bypass valve closed |
| B-3 | New Method | 0.18 | 6'30" | 8.78 | 64.4 | Float trap optimal orifice |

G: Water amount
T1: Initial water tank temperature
T2: Final water tank temperature $$G = \text{Width (m)} \times \text{Length (m)} \times \text{Depth (m)} \times \text{Specific weight (kg/m}^3\text{)}$$
$$= 0.396 \times 0.9 \times 0.365 \times 1000 = 130 \text{ (kg)}$$

T1 = 20 (° C.)
T2 = 60 (° C.)

It was confirmed from the test results that the time required for and the amount of steam that is used to increase the temperature can be reduced and that heat transfer can be realized with good efficiency by utilizing sensible heat, in comparison with conventional configuration by using the steam heat exchanger 1 of the present example. Also, the radiation loss from the condensate pipeline can be considerably reduced because the drain temperature is also low. The test of the present example was carried out during temperature elevation, but if fixed temperature retention time is also to be considered, it is apparent that the amount of steam that is used can be considerably reduced in comparison with a conventional steam heat exchanger.

Here, the steam trap 8 is used as a drain discharge device in the present example. Instead of using the steam trap 8, as shown in FIG. 1(*b*), an orifice 13 having a prescribed bore diameter can also be used. In other words, it is sufficient to provide an orifice 13 having a prescribed bore diameter instead of a steam trap 8 or another drain discharge device because only compressed water is present in the sensible heat transfer pipe parts 12 and the downstream side thereof. Also, if this servicing is not desirable, the mounting position for the orifice 13 may be at an intermediate position of sensible heat transfer part. In cases where the orifice 13 is used, the bore diameter may be set so that the drain discharge capacity is the same as the amount of condensation at the service temperature of the steam heat exchanger 1.

A metering valve may be used as a drain discharge device. The steam heat exchanger of the present example may also be applied to a steam heat exchanger used in a pressurized tank.

Embodiment 2

Figure 2:
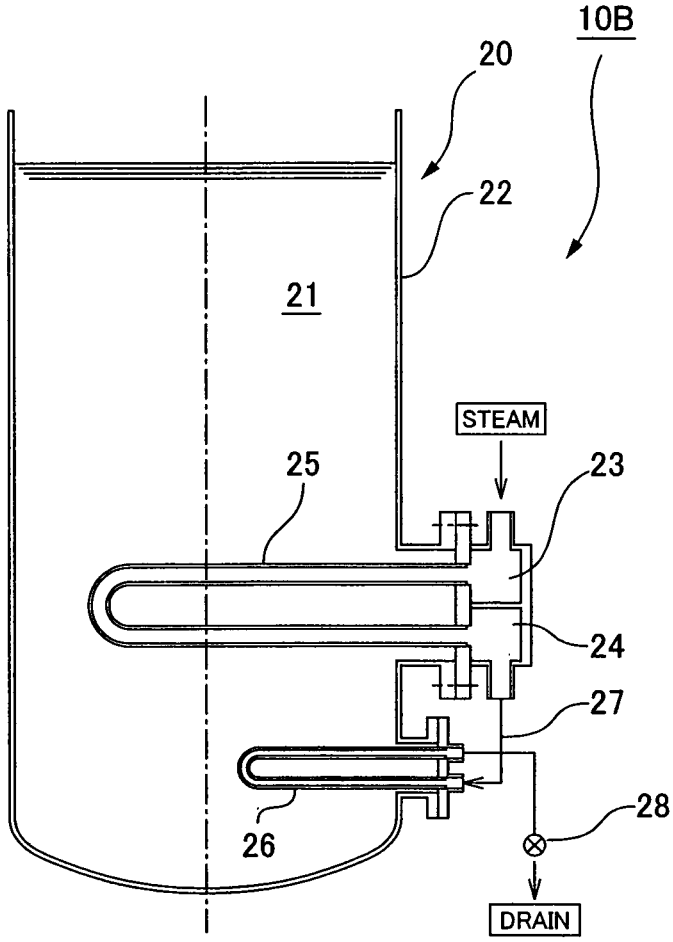
FIG. 2 is a schematic structural diagram showing a separate example of a heating system provided with the steam heat exchanger of the present invention.

FIG. 2 is a schematic structural diagram showing a separate example of a steam heat exchange system provided with a steam heat exchanger in which the present invention has been applied. A steam heat exchange system 10B has a steam heat exchanger 20 and a vertically arranged open tank 22 that holds a treatment fluid 21. The steam heat exchanger 20 is provided with a steam supply port 23 and discharge port 24 mounted on the side part of the open tank 22, a U-shaped condensation heat transfer pipe 25 that extends horizontally toward the interior from the steam supply port and discharge port, and a U-shaped sensible heat transfer pipe 26 that extends horizontally toward the interior of the open tank in the same manner on the lower side of the heat transfer pipe 11. The upstream end of the sensible heat transfer pipe 26 is in communication with the discharge port 23 via the pipe 27 outside of the open tank 22, and the downstream end of the sensible heat transfer pipe 26 is in communication with the steam trap or another drain apparatus 28.

Effects similar to those of the aforementioned steam heat exchanger 1 can be obtained in the steam heat exchanger 20 in the steam heat exchange system 10B having this configuration. An orifice may be used in the drain discharge device 28 in the steam heat exchanger 20 as well. Furthermore, the steam heat exchanger 20 of the present example can be applied to a steam heat exchanger used in a pressurized tank.

The invention claimed is:

1. A steam heat exchange system for heating a treatment fluid by using steam as a heat medium, comprising a treatment tank for confining said treatment fluid, a heat pipe disposed in the treatment tank, a steam supply pipe connected to an upstream end of the heat pipe, a drain conduit connected to a downstream end of the heat pipe and an orifice having a prescribed diameter provided at a downstream portion of the drain conduit, wherein the heat pipe has a condensation heat transfer pipe part on an upstream side thereof and a sensible heat transfer pipe part on a downstream side thereof and the orifice is operable to discharge an amount of drain which is the same as the amount of condensation of the steam produced in the condensation heat transfer pipe part at a service temperature of the steam heat exchange system, thereby maintaining the sensible heat transfer pipe part in a water sealed condition.

* * * * *